US005752448A

United States Patent [19]

Eyre

[11] Patent Number: 5,752,448

[45] Date of Patent: May 19, 1998

[54] MOTORIZED TABLE

[75] Inventor: Clarence W. Eyre, Dry Prong, La.

[73] Assignee: Baker Manufacturing Co., Inc., Pineville, La.

[21] Appl. No.: 474,898

[22] Filed: Jun. 7, 1995

[51] Int. Cl.[6] ..... A47B 85/00

[52] U.S. Cl. ..... 108/20; 108/144

[58] Field of Search ..... 108/147, 20, 21, 108/144, 106; 74/665 L, 665 P; 318/287

[56] References Cited

U.S. PATENT DOCUMENTS

| | | | |
|---|---|---|---|
| 544,836 | 8/1895 | Vetter . | |
| 2,541,075 | 2/1951 | Koch . | |
| 2,822,228 | 2/1958 | Carlson . | |
| 2,982,050 | 5/1961 | May . | |
| 3,162,317 | 12/1964 | Becker . | |
| 3,213,809 | 10/1965 | Kritske . | |
| 3,364,881 | 1/1968 | Kooi . | |
| 3,887,155 | 6/1975 | Bertolot | 108/144 |
| 3,903,812 | 9/1975 | Cowley . | |
| 3,908,560 | 9/1975 | Horner . | |
| 4,130,069 | 12/1978 | Evans et al. . | |
| 4,440,096 | 4/1984 | Rice et al. . | |
| 4,469,029 | 9/1984 | Ramond . | |
| 4,474,115 | 10/1984 | Carlton . | |
| 4,550,666 | 11/1985 | Svoboda . | |
| 4,567,835 | 2/1986 | Reese et al. . | |
| 4,637,322 | 1/1987 | Hampshire et al. . | |
| 4,641,067 | 2/1987 | Iizwasa et al. | 318/287 |
| 4,667,605 | 5/1987 | Bastian . | |
| 4,712,653 | 12/1987 | Franklin et al. . | |
| 4,717,112 | 1/1988 | Pirkle . | |
| 4,747,353 | 5/1988 | Watt . | |
| 4,751,884 | 6/1988 | Ball . | |
| 4,805,538 | 2/1989 | Fisher et al. . | |
| 4,815,391 | 3/1989 | Lee . | |
| 4,826,123 | 5/1989 | Hannah et al. . | |
| 4,938,441 | 7/1990 | Hannah et al. . | |
| 5,005,492 | 4/1991 | Ogino et al. . | |
| 5,041,770 | 8/1991 | Seiler et al. . | |
| 5,101,736 | 4/1992 | Bommarito et al. . | |
| 5,131,333 | 7/1992 | Karasawa et al. . | |
| 5,271,320 | 12/1993 | Reneau . | |
| 5,322,025 | 6/1994 | Sherman et al. . | |
| 5,339,750 | 8/1994 | Smies . | |
| 5,398,622 | 3/1995 | Lubinskas et al. . | |

FOREIGN PATENT DOCUMENTS

| | | |
|---|---|---|
| 813763 | 5/1969 | Canada . |
| 2508294 | of 0000 | France . |
| 3347296 | 11/1985 | Germany . |
| 3701797 | 4/1988 | Germany . |
| 530491 | 3/1955 | Italy . |
| 99489 | 6/1923 | Switzerland . |
| 441653 | 1/1968 | Switzerland . |
| 657286 | 9/1951 | United Kingdom . |
| 774129 | 5/1957 | United Kingdom . |

*Primary Examiner*—Peter M. Cuomo
*Assistant Examiner*—Gerald A. Anderson
*Attorney, Agent, or Firm*—Howard L. Rose

[57] ABSTRACT

A work station has a work platform adopted for generally vertical movement by means of an electric motor through a drive shaft and sprocket arrangement that drives an endless belt or chain around a pair of vertically aligned sprockets on each side of the station, the work platform being carried on supports secured to the belt or chain to impart vertical movement to the supports and thus to the work platform.

10 Claims, 4 Drawing Sheets

MOTORIZED TABLE

RELATED APPLICATIONS

This application is related to application Ser. No. 07/956,157 filed on Oct. 5, 1992 for "Computer Work Station" and application Ser. No. 08/261,051 filed Jun. 13, 1994 for "Computer Work Station".

FIELD OF THE INVENTION

The present invention relates to a table with a vertically adjustable work surface and more particularly to a motorized computer work station for raising and lowering the monitor platform; the keyboard platform moving with the monitor platform and adjustable relative thereto.

BACKGROUND OF THE INVENTION

Numerous patents have been obtained on the mechanisms for raising and lowering work surfaces particularly, though certainly not necessarily, the monitor platforms for computer work stations. Two patent application for such mechanisms are those cited above in "Related Applications". The majority of these devices employ springs or the like to assist in raising and lowering the monitor platform although those of the "Related Applications" are counterweighted and are relatively easy to move since the weight of the platform does not have to be lifted; only that of the monitor and perhaps the keyboard.

In these prior structures, a lever or knob is operated to release the locking mechanism of the monitor platform so that the platform may be manually raised or lowered to a desired position and the locking mechanism is re-engaged. In many, if not most computer work stations of the adjustable type, the keyboard platform is adjustably suspended from the monitor platform.

OBJECTS OF THE INVENTION

It is an object of the present invention to provide a motorized mechanism for adjusting the position of a work platform.

It is another object of the present invention to provide a motorized mechanism for raising and lowering the monitor support table of a computer console.

Yet another object of the present invention is to provide a simple, inexpensive motor control for controlling vertical movement of a table or other horizontal platform.

Still another object of the present invention is to provide a motor for moving a work platform along a generally vertical path whereby the operator is not required to apply force to accomplish such movement.

BRIEF DESCRIPTION OF THE PRESENT INVENTION

The motorized work platform forms the subject matter of the present invention; the adjustable keyboard being disclosed and claimed in the Related Applications. Thus the inventive feature claimed herein is the work platform which can be used for any purpose even though the specification refers to it as a monitor platform.

A platform, preferably horizontal, is slidable in vertical guides supported in sidewalls at both ends of the platform and may be raised or lowered by motor driven chains. A single reversible motor located between the sidewalls has a horizontal shaft that extends through the sidewalls supporting the slides. The shaft is located at approximately one end of vertical travel of the platform and carries sprockets at its two ends. The sprockets engage chains each extending in a loop about such sprocket and a sprocket disposed at the other end of vertical travel of the platform. The platform carries fittings that connect to the chains so that rotation of the motor moves the chains vertically and the platform moves with the chains.

A keyboard platform, when the present invention is employed as a computer console, is carried by the monitor platform and may be adjusted relative thereto as disclosed in either of the "Related Applications".

The above and other features, objects and advantages of the present invention, together with the best means contemplated by the inventor thereof for carrying out the invention will become more apparent from reading the following description of a preferred embodiment and perusing the associated drawings in which:

DETAILED DESCRIPTION OF THE PRESENT INVENTION

Figure 1:
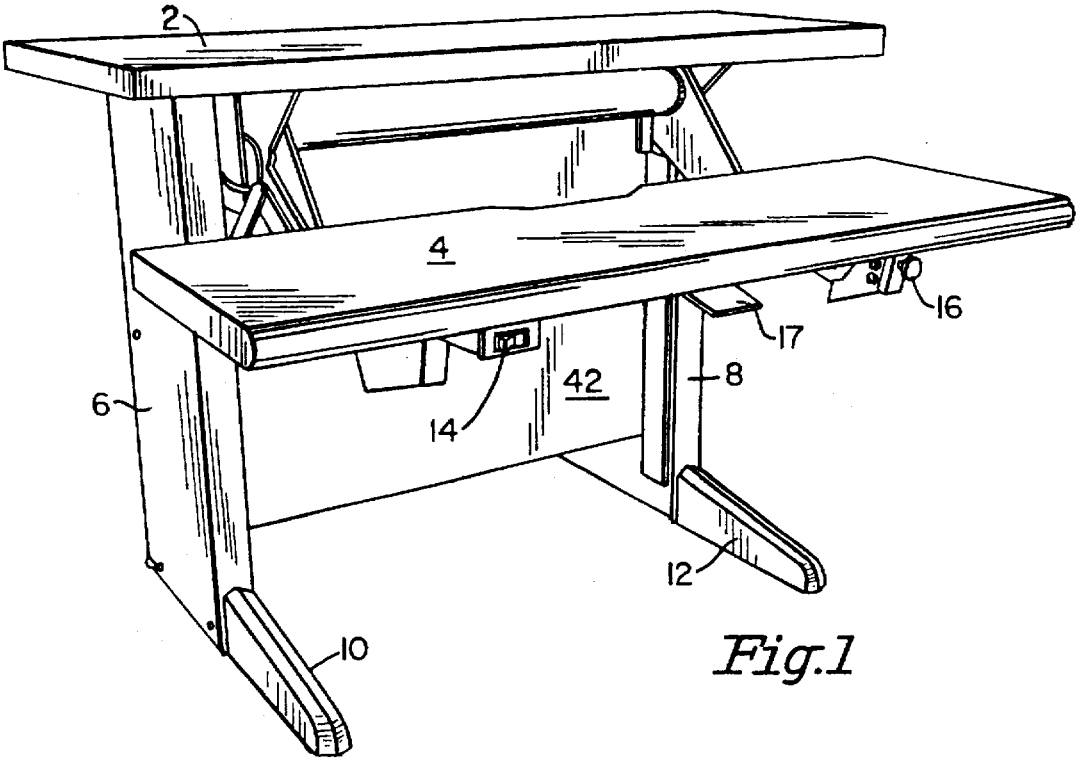
FIG. 1 is a perspective, primarily front view of the work station showing the monitor and keyboard platforms in their down positions.
Figure 2:
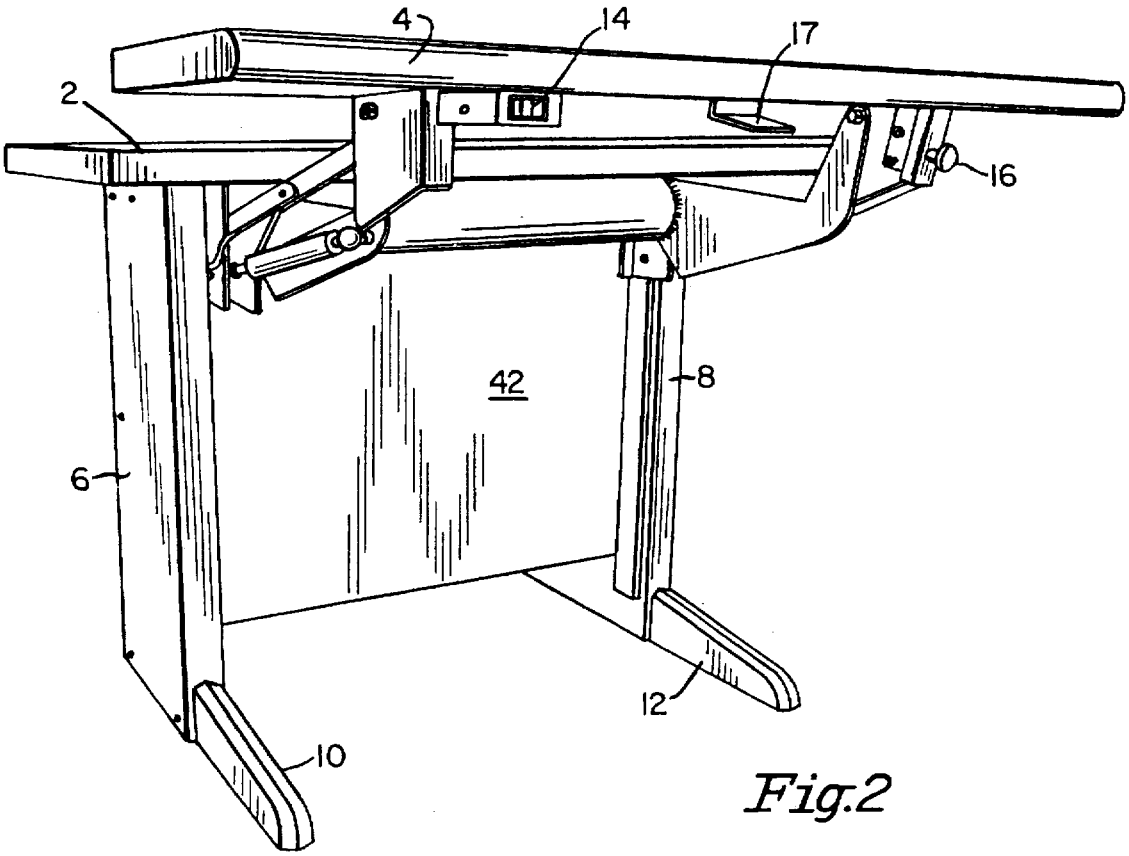
FIG. 2 is a perspective, primarily front view showing the monitor platform in its down position and the keyboard platform up.

Referring now specifically to FIGS. 1 and 2 of the accompanying drawings, the work station includes a vertically movable motor driven monitor platform 2 and a keyboard platform 4 suspended from the monitor platform 2. The keyboard platform is manually adjustable relative to the monitor platform by mechanisms disclosed in either of the "Related Applications"; application Ser. No. 07/956,157 having allowed claims. The part of that application relating to the keyboard platform being incorporated herein by reference.

The work station includes outer sidewalls 6 and 8, a front panel 9 extending between the sidewalls and feet 10 and 12 extending from the sidewalls 6 and 8, respectively, to a position at least partially under the keyboard platform 4. Carried at the front of the keyboard platform 4 is a single pole, double throw switch 14 for controlling rotation of the motor, to be described subsequently, for raising and lowering the platform 2. A lever 17 at the front right of the keyboard platform is employed to release the keyboard platform 4 for vertical movement relative to platform 2. A knob 16 is employed to permit tilt of the keyboard platform front to back.

Figure 3:
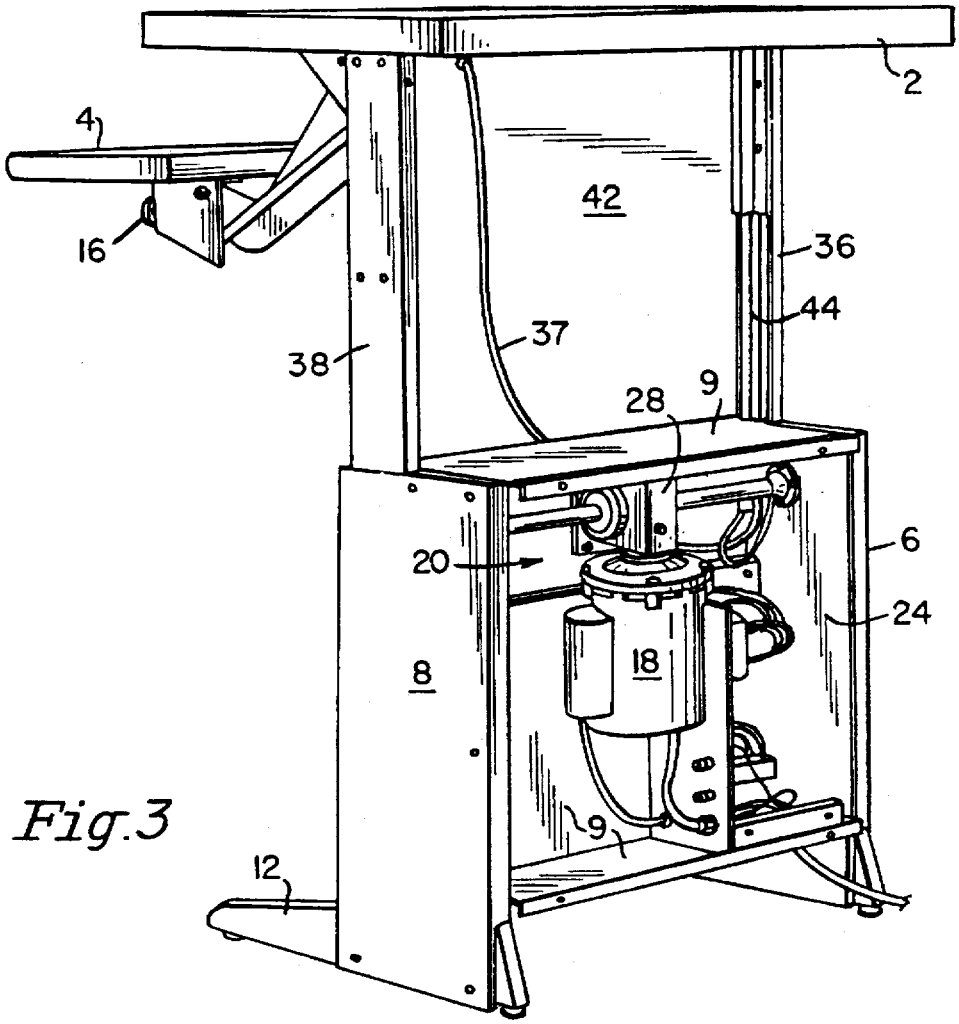
FIG. 3 is a perspective view from the back showing the motor located between inner sidewalls of the structure.
Figure 4:
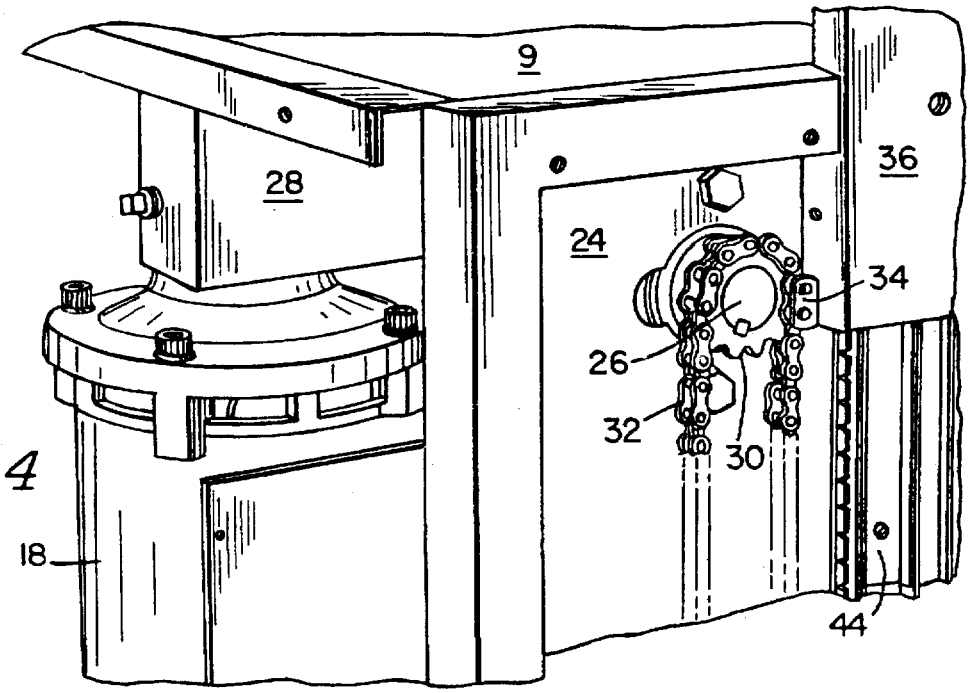
FIG. 4 is a perspective view of the detail of the relative positions of the motor, a sprocket driven by the motor, the chains driven by the sprocket and the attachment of the monitor or work platform to a chain to move vertically with it.

Referring now to FIG. 3 of the accompanying drawings, a motor 18 is secured to a gear box 28 secured to plate 20, spot welded to panel 9 supported between the inner sidewalls only one of which, sidewall 24 is illustrated. The motor 18 drives a shaft 26 through the gear box 28; the shaft 26 extending through the inner sidewalls, such as sidewall 24, into a space between the inner and outer sidewalls such as 24 and 6; refer to FIG. 4. The shaft 26 carries a sprocket on both of its ends, the sprocket located between inner and outer sidewalls 24 and 6 being designated by reference numeral 30. The sprocket drives a chain 32 to which is attached a plate 34 extending from a side panel 36 constituting one of the supports of the platform 2. Note wire 37 that provides connection of the motor circuit to the switch 14.

Figure 5:
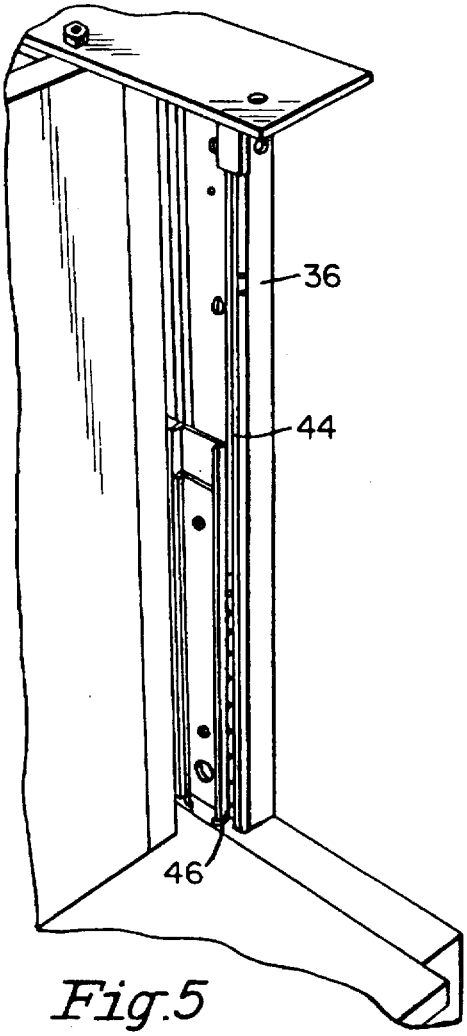
FIG. 5 illustrates a side perspective view from the back of the structure illustrating one of the slides in which the work platform moves upon vertical movement.

Referring again to FIG. 3, the platform 2 is supported on side panels 36 and 38, with a panel 42 extending therebetween. One half of a pair of dual telescoping ball bearing slides slide 44 is illustrated, and is permanently secured (see also FIG. 5) to the inner surface of the side panels 36 and 38 with other stationary member 46 of the slide secured between walls 24 and 6.

Figure 6:
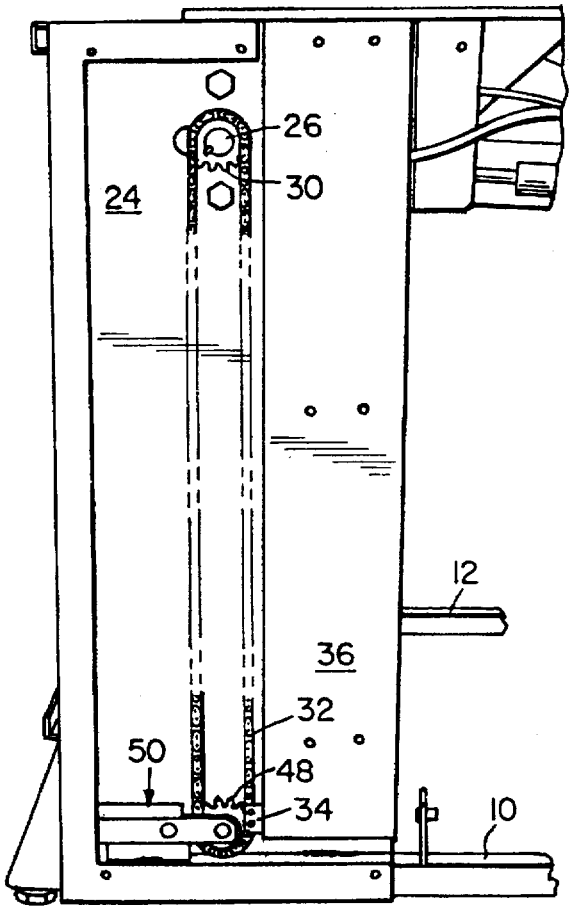
FIG. 6 illustrates the entire run of the sprocket driven chain and the top and bottom sprocket about which the chain travels, the attachment of the platform to the chain and a rocker mechanism to provide limited accommodation to gear backlash.

Referring to FIG. 6, a second sprocket 48 is secured to a rocker mechanism 50 with the endless chain 32 passing as a continuous loop over the sprockets 48 and 30. In this Figure, the plate 34 is at the bottom of the structure indicating that the platform 2 is in its lowermost position.

Figure 7:
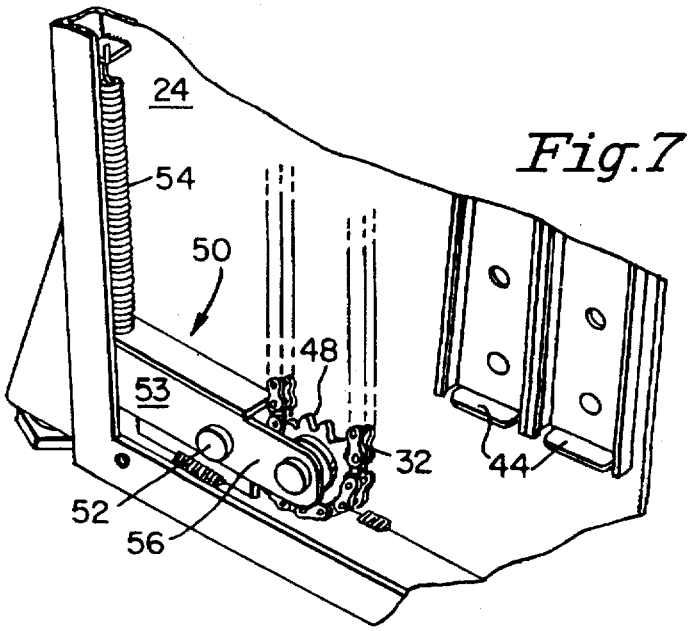
FIG. 7 illustrates the rocker mechanism of FIG. 6.

Referring to FIG. 7 the rocker mechanism 50 includes an elongated bracket 53 having the sprocket pivotally held between legs 56 and another leg not illustrated. The bracket 53 is pivoted about a shaft 52 and is held in its clockwise most position by a tension spring 54. The bracket 53 rocks about shaft 52, constrained by spring 54, to accommodate irregular movement of the chain 32.

Figure 8:
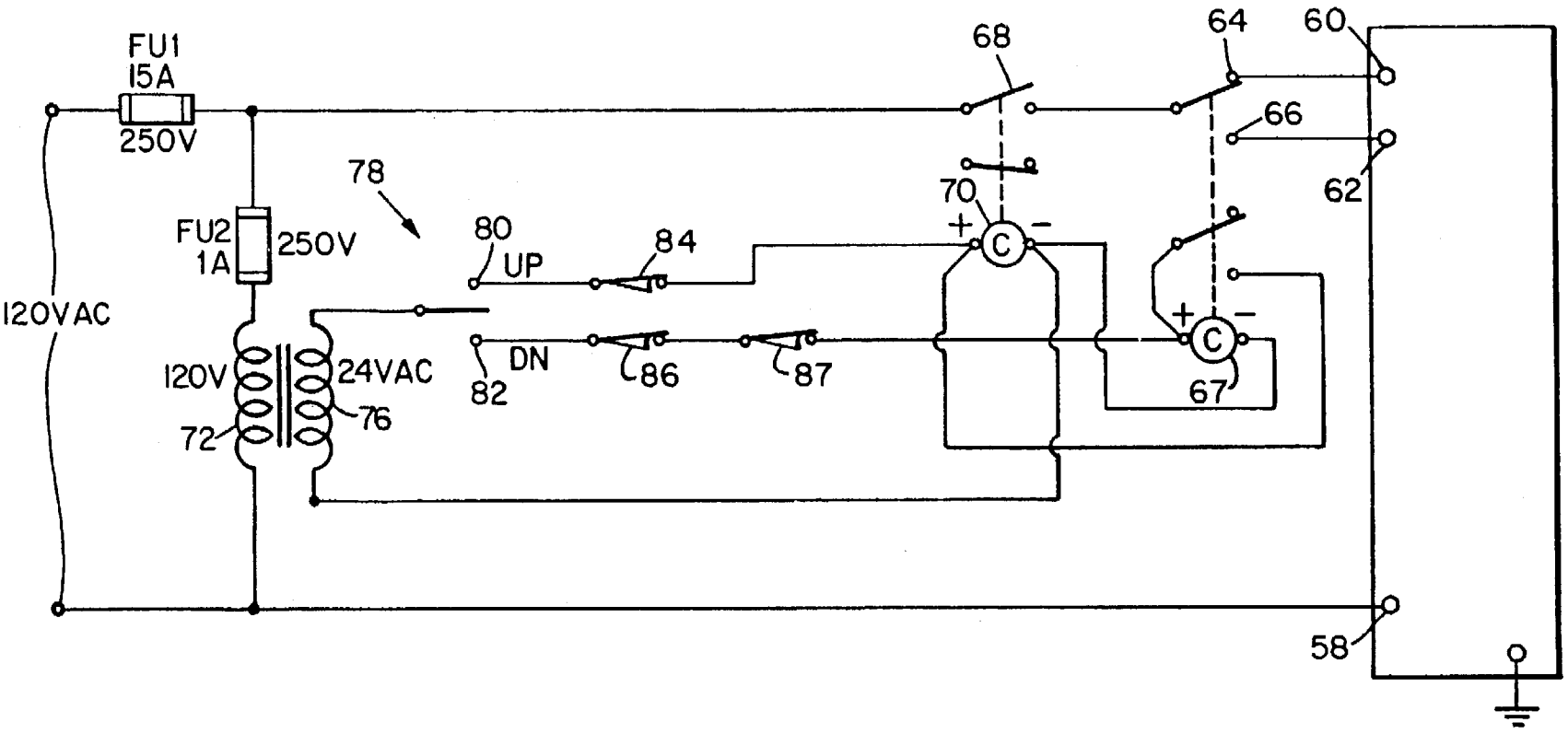
FIG. 8 is an electrical diagram of a motor control circuit.

Referring now to FIG. 8 of the accompanying drawings, the motor 18 has a ground connection 58 connected to line neutral. The motor, a Leeson Model No. M4P17DC70, has clockwise drive and counterclockwise drive terminals 60 and 62, respectively, connected via contacts 64 and 66, respectively, of relay 67 and through contacts 68 of relay 70 to the hot side of an input line.

A primary winding 72 of a transformer 74 is connected across the power input line. The transformer has a secondary winding 76 connected through an up-down rocker switch 78 having an up terminal 80 and a down terminal 82. The up terminal 80 when contacted actuates relay 70 to close contact 68 to supply power to terminal 60 of the motor 18 via contact 64. The motor runs clockwise and raises the platform 2. If the rocker switch is actuated to engage contact 82 both relays 67 and 70 are energized and power is supplied to terminal 62 and the motor rotates in a counterclockwise direction.

It is noted that limit switches 84 and 86 are inserted in the lines to the up and down relays 70 and 67, respectively. While the motor has an internal overload switch, for thermal protection, a limit switch 87 is used to prevent damage to the user's knees upon downward motion of the platforms; such damage resulting from contact with the keyboard support arms.

The range of vertical movement of the previously available platforms known to the inventor was about 12 inches because of the weight to be overcome. The platform of the present invention has a vertical movement of 18-¾ inches since the motor carries the load. As can be determined by the prior discussion, the power drive consists primarily of the motor, the gear box drive, the cross shaft, the drive sprockets and the drive chain.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. A motorized work table comprising a work platform, a base, supports for said work platform, said supports disposed in said base for vertical movement relative thereto, a motor interconnected with said supports to raise and lower said work platform, an electric circuit for energizing said motor, and a limit switch connected in the circuit for energizing said motor to prevent movement of said platform against an obstruction.

2. A motorized work table according to claim 1 further comprising a pair of slides each connected between a different support and an adjacent region of said base.

3. A motorized work table according to claim 2 wherein said slides are telescoping slides comprising at least three members each.

4. The motorized work table according to claim 1 wherein said shaft is permanently located adjacent an end of travel of said supports.

5. A motorized work table comprising a work platform, a base, supports for said work platform, said supports disposed in said base for vertical movement relative thereto, a motor interconnected with said supports to raise and lower said work platform, said motor having a horizontal shaft, said motor rotating said shaft, a first pair of sprockets with one mounted on each end of said shaft for rotation therewith and means interconnecting said sprockets to said supports to produce vertical movement of said supports, a pair of stationary sidewalls each disposed on a different side of the work table and inwardly of said supports, said shaft extending through and secured in said stationary sidewalls, said sprockets attached to said shaft between said stationary sidewalls and said supports.

6. The motorized work table according to claim 5 further comprising a front panel extending between said sidewalls, said motor located behind said front panel.

7. A motorized work table comprising a work platform, a base, supports for said work platform, said supports disposed in said base for vertical movement relative thereto, a motor interconnected with said supports to raise and lower said work platform, a horizontal shaft, said motor rotating said shaft, a first pair of sprockets with one mounted on each end of said shaft for rotation therewith and means interconnecting said sprockets to said supports to produce vertical movement of said supports, an electric circuit for energizing said motor and an overload switch for preventing injury to a worker at the platform in downward motion upon contact with a body member of such a worker.

8. A motorized work table according to claim 7 wherein said means comprises a second pair of sprockets, each generally vertically aligned with a different one of said first pair of sprockets, a different endless member disposed about each pair of vertically aligned sprockets for movement around said sprockets, said supports connected to said endless members to move said supports with said endless members.

9. The motorized work table according to claim 8 further comprising means for providing limited accommodation to gear backlash.

10. The motorized work table according to claim 9 wherein said means to comprises rocker mechanisms connected to said second pair of sprockets.

* * * * *